US005211416A

United States Patent [19]

Blacklaw

[11] Patent Number: 5,211,416

[45] Date of Patent: May 18, 1993

[54] TRAILER COUPLING ADAPTOR

[76] Inventor: William G. Blacklaw, 22396 So. Parrot Creek Rd., Oregon City, Oreg. 97045

[21] Appl. No.: 949,758

[22] Filed: Sep. 23, 1992

Related U.S. Application Data

[63] Continuation of Ser. No. 787,411, Nov. 4, 1991, abandoned.

[51] Int. Cl.[5] ..... B60F 5/00

[52] U.S. Cl. ..... 280/416.1; 280/495; 280/504; 280/511

[58] Field of Search ..... 280/416.1, 416.3, 495, 280/477, 500, 452, 457, 486, 491.1, 504, 511, 507

[56] References Cited

U.S. PATENT DOCUMENTS

| | | | |
|---|---|---|---|
| 3,837,674 | 9/1974 | Rathsack | 280/417 |
| 3,848,893 | 11/1974 | Patterson | 280/416.3 |
| 4,176,852 | 12/1979 | Collin | 280/416.1 |
| 4,379,569 | 4/1983 | Koch | 280/416.1 |

FOREIGN PATENT DOCUMENTS 1016570 9/1957 Fed. Rep. of Germany .

*Primary Examiner*—Russell D. Stormer
*Assistant Examiner*—Peter C. English
*Attorney, Agent, or Firm*—Chernoff, Vilhauer

[57] ABSTRACT

An adaptor allows a trailer coupling designed to be used with an annular eye-type trailer drawbar to be quickly and easily changed into a standard ball-type coupling. The adaptor includes a crossbar that mates with the arcuate surface located at the inside bottom portion of the pintle. The adaptor includes parallel side-by-side vertical mounting plates that fit over the pintle and have aligned holes extending through them. A bore is placed in the body of the trailer coupling coaxially with the holes in the mounting plates when the adaptor is mounted on the coupling. A pin is inserted through the aligned mounting holes and bore, securing the coupling to the adaptor. The existing latch on the trailer coupling will engage the top of the pintle and prevent the unintended or accidental uncoupling of the adaptor from the coupling. The adaptor may easily be removed and the coupling returned to its former configuration.

4 Claims, 1 Drawing Sheet

TRAILER COUPLING ADAPTOR

This application is a continuation of application Ser. No. 07/787,411, filed Nov. 4, 1991, now abandoned.

BACKGROUND AND SUMMARY OF THE INVENTION

This invention relates to an adaptor that allows a pintle-type trailer coupling designed to be used with an annular eye-type trailer drawbar to be quickly and easily changed into a spherical ball-type trailer coupling.

Trailer couplings that are attached to the bumper or under-carriage of a towing vehicle are generally of two common types; a pintle-type or a spherical ball-type. Trailer drawbars are equipped to mate with one type of coupling or the other. A problem arises when it is desired to have a vehicle equipped with a pintle-type of trailer coupling tow a trailer with a spherical ball-type receptacle.

Prior attempted solutions to the above-mentioned problem have been unacceptable. One solution has been to mount a pintle-type trailer coupling and a spherical-ball type trailer coupling side-by-side on a towing vehicle. Depending upon the design of the vehicle and the method and location that the trailer couplings are designed to be attached to, the attachment of two trailer couplings may or may not be possible or practical. In the very least, mounting two trailer couplings side-by-side requires that at least one of the trailer couplings, or perhaps both, be mounted in a position offset from the centerline of the towing vehicle. This creates an inherently unsafe condition because the trailer and towing vehicle will track differently.

Another solution has been to provide a spherical ball-type coupling that is configured to receive a drawbar eye over the ball. Placing a drawbar eye over a ball rather than a pintle causes loads to be transferred through a small surface area and thus results in rapid wear of both elements.

The subject invention overcomes the foregoing problem by providing a ball carrying adaptor that releasably mounts on a pintle-type trailer coupling. The adaptor includes a crossbar that conformingly mates with the arcuate surface located on the inside of the pintle, resulting in a firm fit between the mated surfaces. The adaptor includes two vertical plates that are spaced apart slightly more than the width of a standard pintle. Aligned mounting holes are located in the vertical plates and a bore is placed in the body of the coupling coaxially with these holes when the adaptor is mounted on the coupling. A pin may then be inserted through the holes and bore to secure the adaptor in place on the coupling. A tongue provided at the end of the plates contains a hole to receive a standard spherical-ball. When the adaptor is installed, the latch of the trailer coupling will still engage the top of the pintle and assure that the adaptor mechanism will not accidentally disengage from the trailer coupling. This system of securing the adaptor to the trailer coupling assures a snug connection even when there are slight variations in the dimensions of the coupling or wear has occurred. In addition one adaptor can be used on several different size trailer couplings.

Accordingly, it is a principal object of the present invention to provide an adaptor for a pintle-type trailer coupling that allows a spherical towing ball to be mounted on the coupling.

It is a further object of the invention to provide such an adaptor in which a crossbar that conformingly mates with the arcuate surface of the pintle and a pin which fits through aligned openings in the adaptor and coupling securely attach the adaptor to the coupling.

It is a further object of the subject invention to provide such an adaptor in which the aligned openings are located in parallel spaced-apart plates that fit over the pintle.

It is a still further object of the invention to provide such an adaptor in which the crossbar has a circular cross-sectioned shape.

The foregoing and other objectives, features and advantages of the present invention will be more readily understood upon consideration of the following detailed description of the invention taken in conjunction with the accompanying drawings

DETAILED DESCRIPTION OF A PREFERRED EMBODIMENT

Figure 1:
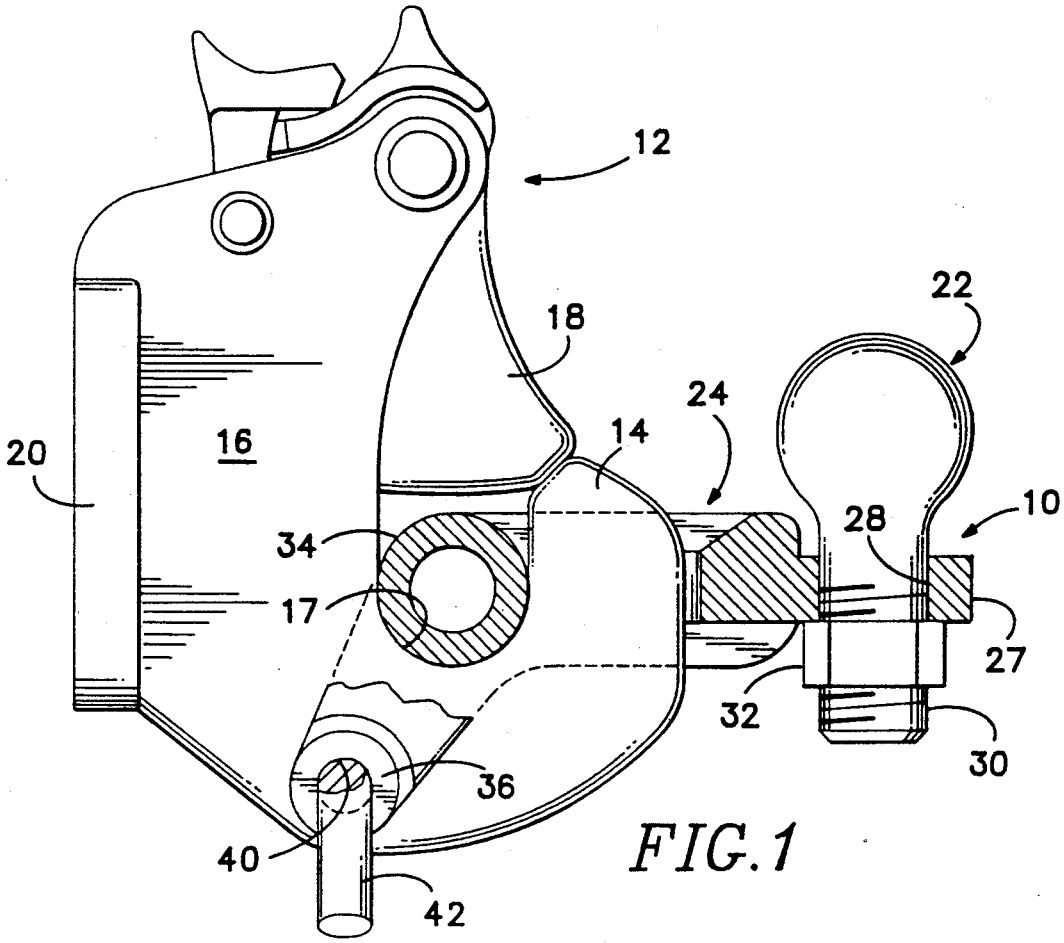
FIG. 1 is a side elevation view of an adaptor embodying the subject invention, mounted on a trailer coupling.

Referring to FIG. 1 of the drawings, the adaptor 10 of the subject invention is used with a trailer coupling 12 having a cylindrical pintle 14 that receives the annular eye of a drawbar (not shown). The pintle extends rearwardly and upwardly from the body 16 of the trailer coupling and has an arcuate surface 17 at its base that cradles the drawbar eye. A latch 18 is movable between a closed position where it extends between the pintle 14 and the body 16 to prevent removal of the drawbar, and an open position where the drawbar can be removed from the pintle. A flat base 20, located at the front of the body, permits the trailer coupling to be attached to a towing vehicle.

Figure 2:
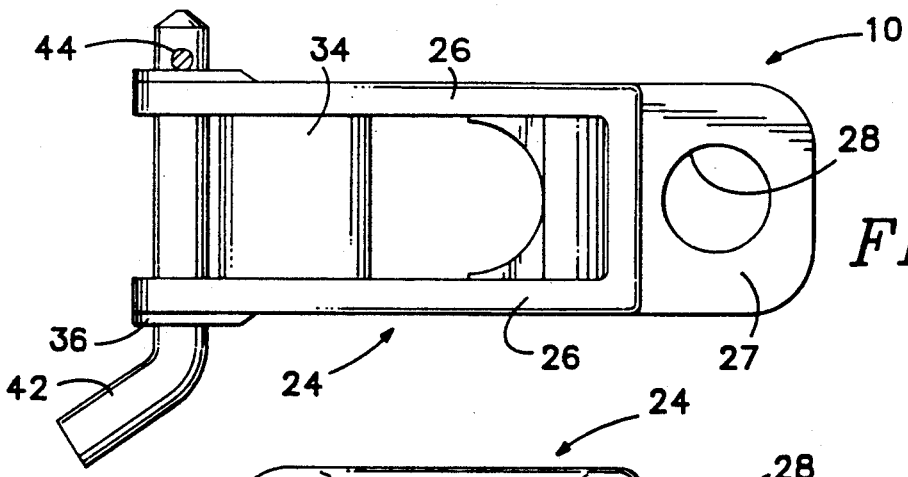
FIG. 2 is a plan view of the adaptor.
Figure 3:
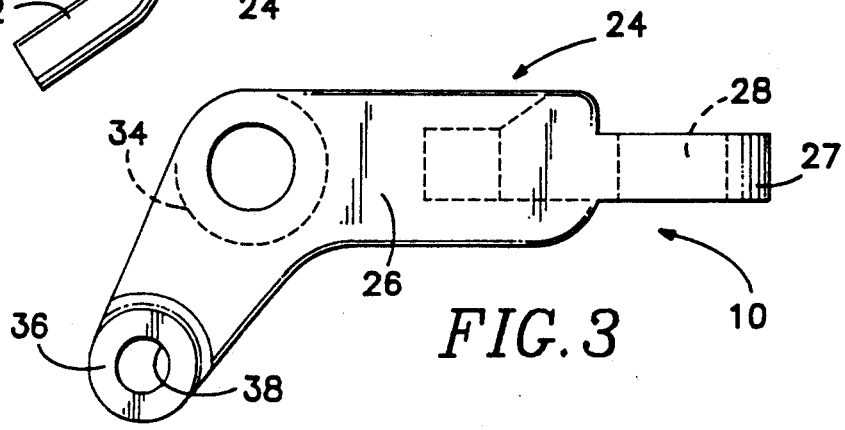
FIG. 3 is a side elevation view of the adaptor.

The adaptor 10 permits a trailer coupling of this type to carry a standard spherical trailer ball 22 so that the trailer coupling can be connected to trailers having spherical cavities as well as eye-type drawbars. Referring now also to FIGS. 2 and 3, the adaptor 10 includes a platform 24 that carries a trailer hitch ball 22 and is releasably mounted on the trailer coupling 12. The platform includes a pair of parallel, spaced-apart, vertical plates 26 that are separated from one another by a distance that is approximately equal to the width of the pintle 14. Located at one end of the plates 26 is a tongue 27 that contains a hole 28 for receiving the threaded shank 30 of the ball 22. A nut 32 is installed on the shank and tightened against the tongue to attach the ball to the adaptor. A crossbar 34 extends between the plates 26 medially in the platform. The lower portion of the outer surface of the crossbar is arcuate and conforms to the arcuate surface 17 of the pintle 14. In the embodiment illustrated, the crossbar is a circular cylinder, which works with most trailer couplings.

Located at the other end of the plates 26 are bosses 36 that have aligned openings 38 extending through them. The plates 26 are L-shaped so that the bosses 36 are located below the crossbar 34 and the tongue 27. A bore 40 extends through the body of the trailer coupling coaxial with the openings 38 when the crossbar 34 is seated in the arcuate surface 17 and the tongue 27 is horizontal. A pin 42 extends through the openings 38 and bore 40 to attach the adaptor to the trailer coupling.

A hole 44 located on the extremity of the pin 42 receives a keeper (not shown) in order to prevent the pin from inadvertently falling out of the coupling.

When the adaptor is mounted on the trailer coupling the contact of the crossbar 34 with the arcuate surface 17 of the pintle, and the pin extending through the openings 38 in the plate 26 and the bore 40 in the coupling body 16 hold the adaptor immovably on the trailer coupling. This attachment mechanism permits the same adaptor to be used on a wide variety of different sized trailer couplings by placing the bore 40 in the trailer coupling body the same distance from the arcuate surface 17 as the holes 38 are from the crossbar 34. In addition, with this attachment mechanism the adaptor will not become loose on the trailer coupling as the coupling wears, since pintle wear primarily occurs on the vertical portions of the pintle rather than around the arcuate surface 17 at its base.

The adaptor can be installed quickly and easily by moving the latch 18 to its open position, placing the adaptor over the pintle with the crossbar 34 seated in the arcuate surface 17 and the holes 38 aligned with the bore 40, and installing the pin 42. After the adaptor is installed, the latch 18 will return to its closed position and prevent the adaptor from separating from the coupling element if the pin 42 were to break.

The adaptor is removed from the trailer coupling simply by removing the pin 42, opening the latch 18 and lifting the adaptor off of the pintle 14.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An adaptor for attaching a trailer hitch ball to a trailer coupling of the type having a body which is attached to a towing vehicle and a drawbar-receiving pintle that extends rearwardly and upwardly from the body and has an arcuate surface, said adaptor comprising:

(a) a platform that is mountable on the trailer coupling, said platform having a first end, a second end and a medial portion, (b) a tongue, having a ball-receiving hole defined therein, located at said first end of said platform and extending rearwardly from the trailer coupling when said platform is mounted thereon;

(c) a crossbar located in said medial portion of said platform, said crossbar having an arcuate portion that conformingly mates with the arcuate surface of the pintle;

(d) attachment means located at said second end of said platform for attaching said platform releasably to the trailer coupling body with said crossbar in contact with the arcuate surface;

(e) wherein said attachment means comprises:

(i) said second end of said platform having a mounting hole defined therein;

(ii) said trailing coupling having a bore defined therein that is aligned with said mounting hole when said crossbar is in contact with the arcuate surface and said tongue is horizontal; and (iii) a pin which fits through said mounting hole and said bore.

2. The adaptor of claim 1 wherein said platform comprises of pair of parallel, spaced-apart plates that are separated from one another by a distance such that they fit snugly over the pintle.

3. The adaptor of claim 2 wherein said crossbar extends between said plates.

4. The adaptor of claim 3 wherein said crossbar is a circular cross-sectioned cylinder.

* * * * *